United States Patent [19]

Gingello et al.

[11] Patent Number: 4,808,516

[45] Date of Patent: Feb. 28, 1989

[54] PHOTOGRAPHIC EMULSION AND ELEMENT

[75] Inventors: Anthony D. Gingello; Hermano P. Rocha, both of Rochester, N.Y.

[73] Assignee: Eastman Kodak Company, Rochester, N.Y.

[21] Appl. No.: 76,095

[22] Filed: Jul. 21, 1987

[51] Int. Cl.[4] ..... G03C 1/10

[52] U.S. Cl. ..... 430/591; 430/600; 430/572; 430/264; 430/949; 430/570

[58] Field of Search ..... 430/600, 593, 595, 603, 430/572, 264, 949, 591, 570

[56] References Cited

U.S. PATENT DOCUMENTS

| | | | |
|---|---|---|---|
| 3,753,721 | 8/1973 | Millikan et al. | 430/595 |
| 3,832,180 | 8/1974 | Douglas | 96/66.3 |
| 4,030,932 | 6/1977 | Chapman | 430/595 |
| 4,334,010 | 6/1982 | Mifune et al. | 430/600 |

*Primary Examiner*—Won H. Louie

*Attorney, Agent, or Firm*—Paul M. Marshall

[57] ABSTRACT

A photographic emulsion comprising silver halide, a spectral sensitizing dye, and rhodanine.

4 Claims, No Drawings

PHOTOGRAPHIC EMULSION AND ELEMENT

Field of the Invention

This invention relates to in general to photography and specifically to photographic emulsions exhibiting good speed and contrast characteristics.

BACKGROUND OF THE INVENTION

In photographic emulsions in general, it is often highly desirable to maximize the photosensitivity, or speed, of the emulsion. It is also often desirable, especially in graphic arts photographic products, such as halftone reproduction materials, to utilize photographic emulsions exhibiting high contrast.

In silver halide photographic emulsions, speed may be increased in a number of ways. Increasing the size of the silver halide grains increases photographic speed; however, it also contributes to a loss of image sharpness. Chemical sensitizers for silver halide, such as sulfur or gold compounds, can be included in the photographic emulsion to increase photographic speed, but the degree of speed increase is limited, and oversensitization can lead to fog or even to a decrease in speed. Spectral sensitizers, such as cyanine dyes, can also increase photographic speed, but the amount of speed increase can fall short of what is desired. Moreover, the above-described photographic speed-increasing techniques often do not increase contrast to the extent desired.

SUMMARY OF THE INVENTION

According to the present invention, it has been found that the speed and the contrast of spectrally-sensitized silver halide photographic emulsions can be increased through the inclusion in the emulsion of rhodanine. This emulsion is advantageously utilized in a layer of a photographic element.

DESCRIPTION OF THE PREFERRED EMBODIMENTS

The silver halide of the invention can be any type of silver halide that is useful in photographic emulsions. This includes silver bromide, silver iodide, silver chlorobromide, silver bromoiodide, silver chlorobromoiodide, or mixtures thereof. The silver halide can be in the form of grains bounded by 100, 111, or 110 crystal planes, as described in *Research Disclosure,* December, 1978, item 17643 (hereinafter referred to as "*Research Disclosure I*"), or in the form of tabular grains, as described in *Research Disclosure,* January, 1983, item 22534, the disclosures of which are incorporated herein by reference in their entirety. The silver halide can be present in any amount known in the art to be useful in photographic emulsions. The silver halide is generally present in the emulsion in an amount such that when it is coated as a layer in a photographic element, the coverage of silver will be from 50 to 1000 mg/ft$^2$.

Various precipitation techniques can be used to prepare silver the silver halide grains of the invention, as is well-known in the art. Examples of such techniques include single-jet, double-jet (including various removal techniques), accelerated flow rate, and interrupted precipitation techniques.

Rhodanine is a well-known compound and can be synthesized by techniques widely known in the chemical synthesis art. Essentially any amount of rhodanine can be used, depending on the effect desired. If only very small increases in speed and contrast are desired, very small amounts of rhodanine may be used. The upper limit of the rhodanine amount depends on other features of the emulsion, such as the type and size of silver halide grains, the presence of other sensitizing dyes, and the like. For example, when the surface of the silver halide grains is fully adsorbed with rhodanine and/or sensitizing dye, the addition of further amounts of rhodanine to the emulsion will not significantly increase the speed of the emulsion. Rhodanine is preferably present in the emulsion in an amount of from 40 to 350 mg/mole Ag.

Rhodanine will provide increases in speed and contrast in combination with any sensitizing dye. Such sensitizing dyes include cyanines, merocyanines, complex cyanines and merocyanines (e.g., tri-, tetra-, and poly-nuclear cyanines and merocyanines), oxonols, hemioxonols, styryls, merostyryls, and streptocyanines.

The cyanine spectral sensitizing dyes include, joined by a methine linkage, two basic heterocyclic nuclei, such as those derived from quinolinium pyridinium, isoquinolinium, 3H-indolium, benz[e]indolium, oxazolium, thiazolium, selenazolinium, imidazolium, benzoxazolinium, benzothiazolium, benzoselenazolium, benzimidazolium, naphthoxazolium, ntphthothiazolium, naphthoselenazolium, thiazolinium, dihydronaphthothiazolium, pyrylium, and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isosquinolin-4-one, and chroman-2,4-dione.

Oxonols, hemioxonols, styryls, merostyryls, and streptocyanines are all known in the art and are disclosed in, for example, Hamer, *The Cyanine Dyes and Related Compounds,* 1964 and James, *The Theory of the Photographic Process,* 4th ed., Macmillan (1977), the disclosures of which are incorporated herein by reference in their entirety. Examples of useful spectral sensitizing dyes for sensitizing silver halide emulsions are those found in U.K. Pat. No. 742,112, Brooker U.S. Pat. Nos. 1,846,300, '301, '302, '303, '304, 2,078,233, and 2,089,729, Brooker et al U.S. Pat. Nos. 2,165,338, 2,213,238, 2,493,747, '748, 2,526,632, 2,739,964, 2,778,823, 2,917,516, 3,352,857, 3,411,916, and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680, and 3,384,486, Lincoln et al U.S. Pat. No. 3,397,981, Fumia et al U.S. Pat. Nos. 3,482,978, and 3,623,881, Spence et al U.S. Pat. No. 3,718,470, and Mee U.S. Pat. No. 4,025,349, the disclosures of which are incorporated herein by reference.

One or more spectral sensitizing dyes may be used to achieve a desired spectral sensitization of the silver halide as well as to achieve results such as supersensitization, as discussed by Gilman in *Photographic Science and Engineering,* Vol. 18, 1974, pp. 418–30. Examples of supersensitizing dye combinations include those disclosed in McFall et al U.S. Pat. No. 2,933,390, Jones et al U.S. Pat. No. 2,937,089, Motter U.S. Pat. No.

3,506,443, and Schwan et al U.S. Pat. No. 3,672,898, the disclosures of which are incorporated herein by reference.

The amount of sensitizing dye in the emulsion can be any amount that is known in the art to be useful for spectral sensitization of silver halide. The quantity of dye employed will vary with the specific dye or dye combination chosen as well as the size and aspect ration of the grains. It is known in the photographic art that optimum spectral sensitization is obtained with organic dyes at about 25 to 100 percent or more of monolayer coverage of the total available surface area of surface sensitive silver halide grains, as disclosed for example, in West et al, "The Adsorption of Sensitizing Dyes in Photographic Emulsions," *Journal of Phys. Chem.*, Vol. 56, p. 1065, 1952 and Gilman et al U.S. Pat. No. 3,979,213. Optimum dye concentration levels can be chosen by procedures taught by Mees, *Theory of the Photographic Process*, Macmillan (1942), pp. 1067–69, the disclosure of which is incorporated herein by reference.

Rhodanine is advantageously used with sensitizing dyes containing a rhodanine heterocyclic ring, such as rhodanine-containing merocyanines. Examples of dyes containing rhodanine heterocyclic rings include 3-ethyl-5-[1-(4-sulfobutyl)-4-(1H)-pyridylidene]rhodanine, 3-ethyl-5-[(3-ethyl-5,6-dimethyl-2-benzotelurazolinylidene]rhodanine, 3-ethyl-5-(2,4-dinitrobenzylidene)rhodanine, 5-m-nitrobenzylidene rhodanine, 5-o-nitrobenzylidene-3-phenylrhodanine, and the like.

The emulsion of the invention preferably includes a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid-treated gelatin such as pigskin gelatin), gelatin derivatives (e.g., acetylated gelatin, phthalated gelatin, and the like), polysaccharides (e.g., dextran, gum arabic, casein, pectin, and the like), and others, as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount known to be useful in photographic emulsions.

The emulsion of the invention can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure*, June, 1975, item 13452 and U.S. Pat. No. 3,772,031.

Other addenda include brighteners, antifoggants, stabilizers, filter dyes, light absorbing or reflecting pigments, vehicle hardeners such as gelatin hardeners, coating aids, dye-forming couplers, and development modifiers such as development inhibitor releasing couplers and bleach accelerators. These addenda and methods of inclusion in the emulsion are well-known in the art and are disclosed in *Research Disclosure I* and the references cited therein.

The emulsion of the invention is preferably contained in a layer of a photographic element. The emulsion, preferably containing a vehicle such as gelatin in addition to the silver halide and rhodanine, can be coated onto a support using techniques well-known in the art. These techniques include immersion or dip coating, roller coating, reverse roll coating, air knife coating, doctor blade coating, stretch-flow coating, and curtain coating.

The emulsion of the invention can be coated simultaneously or sequentially with other emulsion layers, subbing layers, filter dye layers, or interlayers or overcoat layers containing various addenda known to be included in photographic elements, such as antifoggants, oxidized developer scavengers, DIR couplers, antistatic agents, optical brighteners, light-absorbing or light-scattering pigments, and the like. The coated layers of the photographic element may be chill-set or dried, or both. Drying may be accelerated by known techniques such as conduction, convection, radiation heating, or a combination thereof.

The photographic element of the invention can be black and white or color. A color photographic element generally contains three silver halide emulsion layers: a blue-sensitive layer having a yellow color coupler associated therewith, a green-sensitive layer having a magenta color coupler associated therewith, and a red-sensitive layer having a cyan color coupler associated therewith. In a color photographic element, the rhodanine-containing layer is preferably the blue-sensitive layer.

The emulsion of the invention is advantageously utilized in photographic elements requiring good photographic speed and high contrast. Typical of such elements are graphic arts film and paper used in halftone image reproduction, especially materials that utilize a non-lithographic developer. Elements in which the emulsion of the invention can be used include those disclosed in U.S. Pat. No. 4,650,746 and *Research Disclosure*, item 23510, November, 1983.

The invention is further illustrated by the following examples.

EXAMPLES 1–10

Onto one side of a clear polyester support is coated a light-absorbing pelloid layer. Onto the other side of a support is coated an emulsion layer containing gelatin (252 mg/ft$^2$), rhodium-doped silver chlorobromide grains (355 mg/ft$^2$ Ag, mean grain diameter of 0.14 $\mu$m, Cl:Br ratio of 90:10), rhodanine (at levels indicated in Table I), and 3-ethyl-5-[1-(4-sulfobutyl)-4-(1H)-pyridylidene]rhodanine sensitizing dye (at levels indicated in Table I). The coating had a pH of 4.8 and a pAg of 6.8. A layer containing gelatin (45.5 mg/ft$^2$) and a matting agent is coated simultaneously over the emulsion layer.

The element is exposed to a test pattern for 10 seconds to a 3000° K. tungsten and processed with a Kodamatic® 65 Processor. Development is for 34 seconds at 105° F. in Kodak Super Rapid Access Developer®, which utilizes hydroquinone and dimezone as developing agents. Photographic speed and contrast were determined by measuring image density of the test pattern exposure using a densitometer. The results are reported in Table I.

TABLE I

| Example | Rhodanine Level (mg/ft$^2$ | Sensitizing Dye level (mg/ft$^2$ | Relative Speed (0.6 + D-min) | Relative Speed (3.5 + D-min) | Contrast (Density range of 0.1–0.6) | Contrast (Density range of 0.1 –2.5) | Contrast (Density range of 2.5–4.0) | D-min | D-max |
|---|---|---|---|---|---|---|---|---|---|
| Control | 0 | 1.0 | 175 | 149 | 3.97 | 7.68 | 13.46 | 0.034 | 5.83 |
| 1 | 0.285 | 1.0 | 180 | 149 | 3.17 | 6.49 | 10.52 | 0.036 | 5.83 |
| 2 | 0.570 | 1.0 | 193 | 162 | 3.82 | 6.79 | 10.64 | 0.035 | 5.91 |
| 3 | 0.855 | 1.0 | 198 | 174 | 4.73 | 8.79 | 12.13 | 0.042 | 5.91 |
| 4 | 1.140 | 1.0 | 199 | 174 | 4.73 | 8.74 | 11.74 | 0.042 | 5.93 |
| 5 | 1.710 | 1.0 | 191 | 162 | 5.41 | 8.69 | 9.54 | 0.042 | 5.93 |
| Control | 0 | 2.0 | 191 | 165 | 3.90 | 7.65 | 13.49 | 0.030 | 5.91 |
| 6 | 0.285 | 2.0 | 197 | 168 | 3.18 | 6.70 | 11.01 | 0.035 | 5.93 |
| 7 | 0.570 | 2.0 | 202 | 171 | 3.40 | 6.62 | 11.03 | 0.034 | 5.95 |
| 8 | 0.855 | 2.0 | 220 | 196 | 5.15 | 9.29 | 11.94 | 0.034 | 5.79 |
| 9 | 1.140 | 2.0 | 218 | 193 | 4.85 | 9.08 | 10.20 | 0.039 | 5.91 |
| 10 | 1.710 | 2.0 | 210 | 183 | 5.02 | 8.60 | 10.47 | 0.036 | 5.93 |
| Control | 0 | 3.0 | 198 | 170 | 3.50 | 7.23 | 11.39 | 0.028 | 5.92 |
| 11 | 0.285 | 3.0 | 211 | 182 | 3.59 | 7.03 | 11.42 | 0.034 | 5.79 |
| 12 | 0.570 | 3.0 | 223 | 194 | 4.49 | 7.76 | 11.35 | 0.033 | 5.95 |
| 13 | 0.855 | 3.0 | 225 | 199 | 4.43 | 8.42 | 11.23 | 0.033 | 5.92 |
| 14 | 1.140 | 3.0 | 225 | 199 | 4.89 | 8.54 | 10.54 | 0.039 | 5.94 |
| 15 | 1.710 | 3.0 | 214 | 183 | 5.20 | 8.54 | 8.04 | 0.042 | 5.89 |

The results in Table I indicate that photographic emulsions containing silver halide, sensitizing dye, and rhodanine offer improved speed and contrast as compared to photographic emulsions containing just silver halide and sensitizing dye.

What is claimed is:

1. A photographic emulsion comprising silver halide, a spectral sensitizing dye comprising a rhodanine heterocyclic ring, and in a speed and contrast increasing amount from 40 to 450 mg of rhodanine per mole of the silver halide.

2. A photographic emulsion according to claim 1 wherein the sensitizing dye is 3-ethyl-5-[1-(4-sulfobutyl)-4-(1H)-pyridylidene]rhodanine.

3. A photographic element comprising a support having thereon a layer comprising silver halide, a spectral sensitizing dye comprising a rhodanine heterocyclic ring, and in a speed and contrast increasing amount from 40 to 450 mg of rhodanine per mole of the silver halide.

4. A photographic element according to claim 3 wherein the sensitizing dye is 3-ethyl-5-[1-(4-sulfobutyl)-4-(1H)-pyridylidene]rhodanine.

* * * * *